United States Patent [19]

Fenne

[11] 4,447,863

[45] May 8, 1984

[54] HAND-HELD LIGHT WITH SWIVEL HEAD

[76] Inventor: Kenneth R. Fenne, 3 S. 220 Park Blvd., Glen Ellyn, Ill. 60137

[21] Appl. No.: 460,590

[22] Filed: Jan. 24, 1983

[51] Int. Cl.[3] ..... F21L 7/00

[52] U.S. Cl. ..... 362/199; 362/200; 362/269; 362/287; 362/371

[58] Field of Search ..... 362/199, 200, 197, 371, 362/269, 187, 188, 287

[56] References Cited

U.S. PATENT DOCUMENTS

| | | | |
|---|---|---|---|
| D. 173,423 | 11/1954 | Garland | D 48/24 |
| 1,309,140 | 7/1919 | Knoblock | 362/199 |
| 1,699,927 | 1/1929 | Stearns | 362/199 |
| 1,820,960 | 9/1931 | Champagne et al. | 362/197 |
| 1,899,868 | 2/1933 | Herlbauer | 362/199 |
| 2,401,366 | 6/1946 | Muldoon | 362/199 |
| 2,539,974 | 1/1951 | Riddell | 362/199 |
| 2,611,072 | 9/1952 | Potekin | 362/199 |
| 3,233,092 | 2/1966 | Umholtz | 362/183 |
| 3,560,730 | 2/1971 | Morton | 362/199 |
| 3,944,805 | 3/1976 | Moore | 362/194 |

*Primary Examiner*—Stephen J. Lechert, Jr.
*Assistant Examiner*—Howard J. Locker

[57] ABSTRACT

A flashlight has a battery housing and a head on which is mounted a bulb socket. Forwardly directed legs on the housing pivotally engage forwardly directed legs in the head so as swivelly to mount the head to the body.

13 Claims, 8 Drawing Figures

HAND-HELD LIGHT WITH SWIVEL HEAD

BACKGROUND OF THE INVENTION

Hand-held lights, such as battery-operated flashlights, with swivel heads have been available for many years. A flashlight has a housing, a relatively large heavy battery, and a head in which the reflector and flashlight bulb are located. A handle associated with the housing portion can be held by a user in a comfortable position and the head is tilted to a selected position to illuminate as desired. These currently available flashlights cannot be built economically enough to have widespread consumer appeal. Because the structure which swivelly mounts the head to the battery housing is visible, currently available swivel type flashlights are not very attractive either. Also, the interconnection between the head and the housing tends to loosen with age so that the head droops or otherwise fails to remain in a selected orientation.

SUMMARY OF THE INVENTION

It is therefore an important object of the present invention to provide a swivel type flashlight which costs less to manufacture.

Another object is to provide a more attractive swivel type flashlight in which the mounting structure is in large part concealed.

Another object is to provide a swivel type flashlight in which the head is positively retained in a selected orientation.

In summary, there is provided a hand-held light comprising a handle, a support for the handle, a head having an interior, a bulb socket mounted in the head on the interior thereof, at least one leg on the support and extending into the interior of the head, and means in the head rotatably attached to the leg, thereby swivelly mounting the head to the support.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
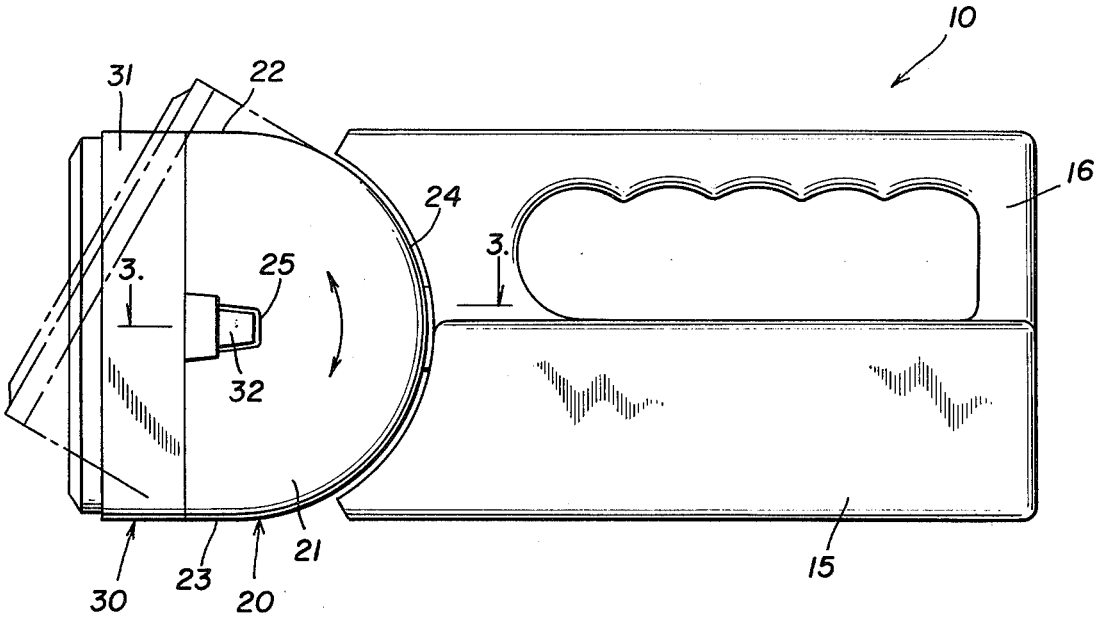
FIG. 1 is a side elevational view of a battery operated flashlight incorporating the features of the present invention, one of the orientations of the head being shown in phantom.
Figure 2:
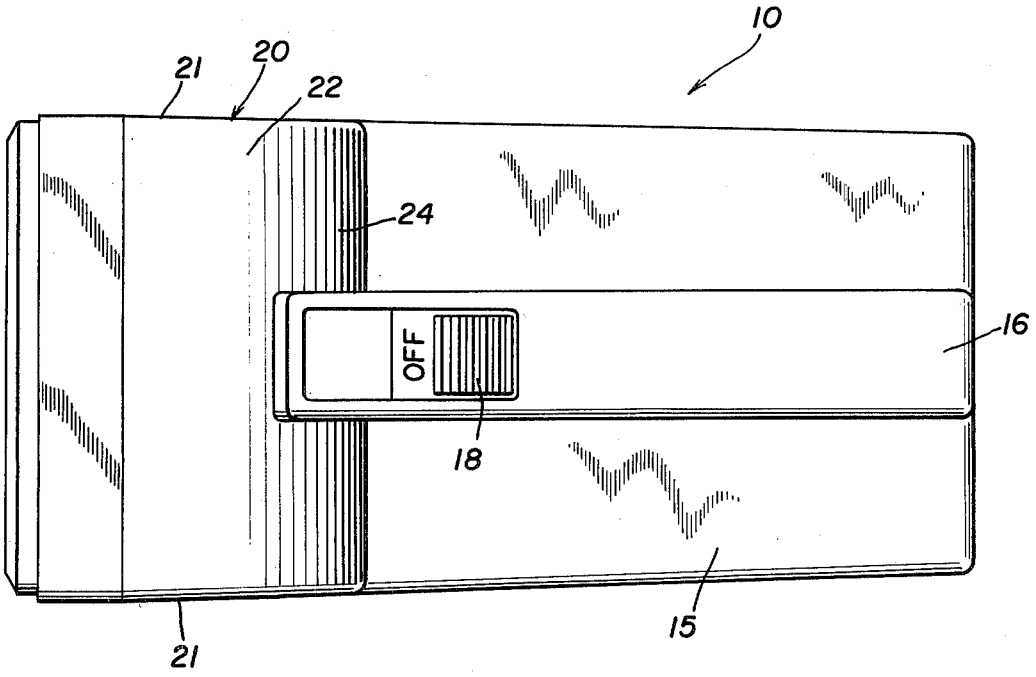
FIG. 2 is a top plan view of the flashlight.

Turning now to the drawings and more particularly to FIGS. 1 and 2 thereof, there is depicted a flashlight constructed in accordance with the present invention, the flashlight being generally designated by the numeral 10. The flashlight 10 includes a housing 15 carrying an upstanding handle 16. The housing has a flat bottom surface so that the flashlight may be placed on a support surface for hands-free operation. The housing 15 contains a battery which preferably is rechargeable, together with a power supply and other electronics for recharging of the battery and the like. Preferably and housing 15 and the handle 16 are molded of plastic in two parts and held together by screws or the like. The housing 15 is generally rectangular and elongated front to back, the front being toward the left as viewed in FIG. 1 and the back being toward the right. The front of the handle 16 and the front of the housing 15 define a continuous, part-cylindrical surface 17. An on-off switch 18 is located in the handle 16 at its front.

The flashlight further comprises a head 20 preferably of one-piece plastic construction having a pair of laterally spaced-apart side walls 2, a top wall 22, a bottom wall 23 and a part-cylindrical rear wall 24 that merges into and is a continuation of the top and bottom walls 22 and 23. The curvature of the rear wall 24 matches the curvature of the surface 17 in the housing 15. Each of the side walls 21 has a keeper in the form of an opening 25 in the front thereof. The flashlight 10 further comprises a cover assembly 30 including a generally rectangular bezel 31. Fingers 32 extend rearwardly from the side walls of the bezel 31 and engage in the openings 25. The cover assembly 30 includes a lens (not shown) which serves to focus the light. A parabolic reflector (not shown) is also included in the cover assembly 30. A socket 37 (FIG. 3) is mounted in the head 20 by means not shown and receives a bulb 38.

Figure 3:
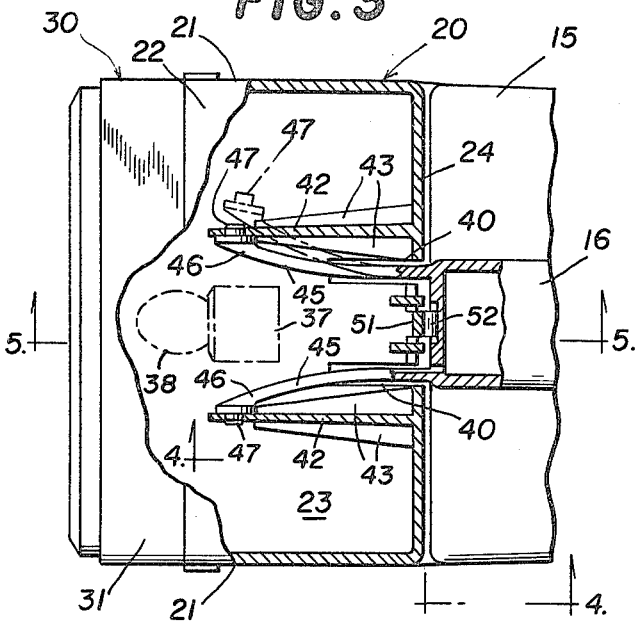
FIG. 3 is a fragmentary, horizontal section taken along the line 3—3 of FIG. 1.
Figure 4:
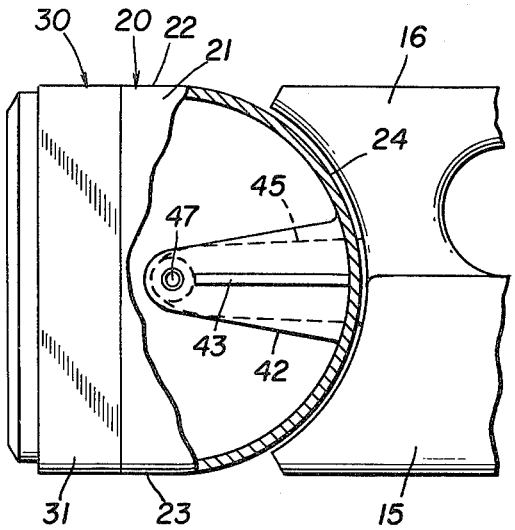
FIG. 4 is a view in vertical section taken along the line 4—4 of FIG. 3.
Figure 5:
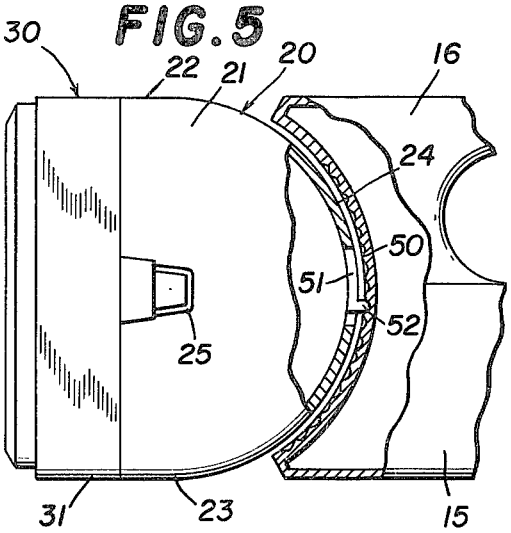
FIG. 5 is a view in vertical section taken along the line 5—5 of FIG. 3.
Figure 6:
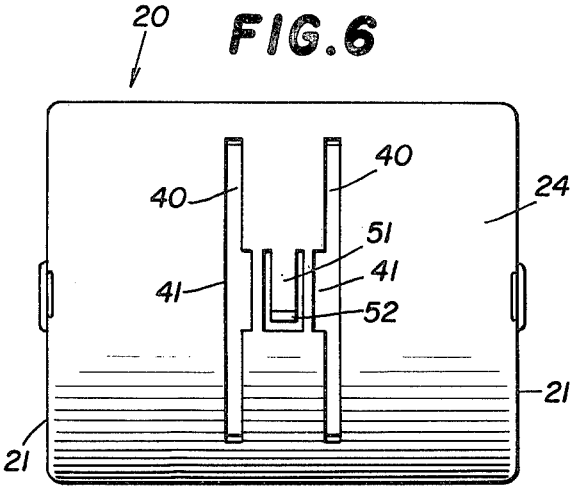
FIG. 6 is a rear elevational view of the head.
Figure 7:
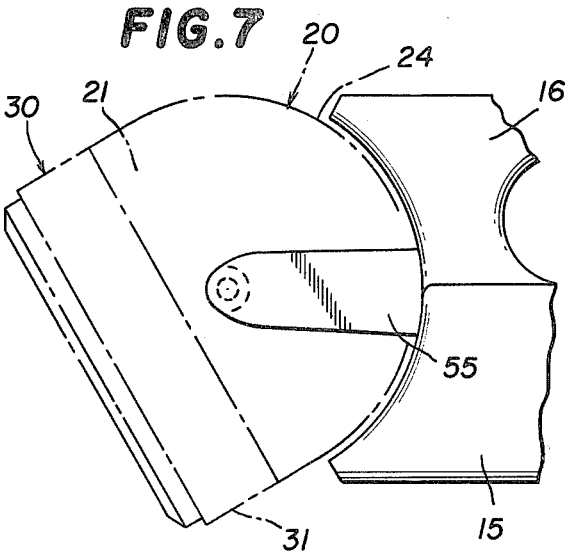
FIG. 7 is a side elevational view like FIG. 4 except that the head is shown in phantom and is downwardly tilted.
Figure 8:
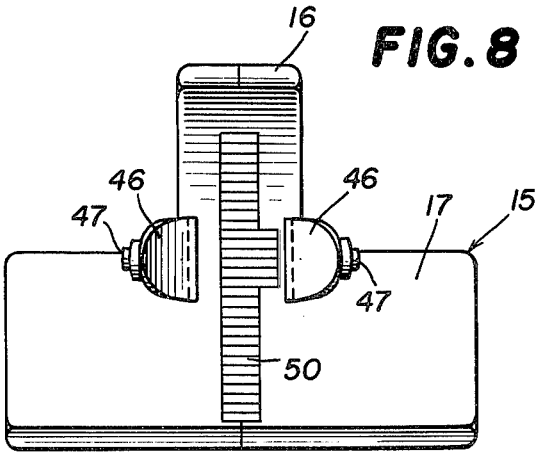
FIG. 8 is a front elevational view of the front of the housing.

Formed in the rear wall 24 of the head 20 is a pair of spaced-apart slits 40 extending between the rear ends of the top and bottom walls 22 and 23. Each slit 40 has an enlarged portion 41 generally at the center portion of the wall 24. Two legs 42 are integral with the rear wall 24 and extend forwardly therefrom, each leg 42 being located between an associated slit 40 and an associated side wall 21, but closely adjacent to the slit. Each leg 42 has rigidifying ribs 43. Protruding forwardly from the wall 24 are two laterally spaced-apart, forwardly extending legs 45 which respectively extend through the slits 40. Each leg 45 has a curved outer end 46 which bears against an associated leg 42. FIG. 3 depicts one of the legs in phantom showing the unbiased condition of each leg. An outwardly directed pin 47 is integral with each leg. The pins 47 are journaled into holes in the outer ends of the legs 42 which pins define an axis about which the head can swivel or rotate. The outward bias of the legs 42 and their bearing against the legs 45 create a firm interconnection between the two, yet accommodate swivel motion of the head 20.

In assembling the head 20 onto the housing 15, the curved ends 46 are urged toward one another until they are aligned with the slits 40. The legs 45 are then inserted into the slits, the enlarged portions 41 accommodating the pins 47. The legs 45 can be released and when the head 20 is moved toward the housing 15 as far as possible, the pins will snap into their respective openings in the ends of the legs 45.

The curved surface 17 has thereon a column of laterally extending ridges 50 located between the legs 45. In the center portion of the rear wall 24 is a finger that is slightly biased outwardly. The free end of the finger 51 carries a rearwardly directed detent 52 which engages in the space between a pair of ridges 50. When it is desired to swivel the head 20 in either direction, the detent 52 is cammed out of a space and moved into the next space and so forth until the head 20 has been swivelled to the desired orientation.

What has been described therefore is a battery operated flashlight which has a swivel head in which the mounting structure is substantially concealed. The plastic construction and the mounting structure described enables and the components to be economical to manufacture and assemble. Positive latching structure insures that the head will remain at a selected orientation.

I claim:

1. A hand-held light comprising a handle, a support for said handle, a head having an interior, a bulb socket mounted in said head on the interior thereof, at least one leg on said support and extending into the interior of said head, and pivot means in said head disposed entirely in the interior thereof and rotatably attached to said leg at a location spaced from said support, thereby swivelly mounting said head to said support.

2. A battery operated flashlight comprising a housing for the battery, a head having an interior, a bulb socket mounted in said head on the interior thereof and coupled to the battery, at least one leg on said housing and extending into the interior of said head, and pivot means in said head disposed entirely in the interior thereof and rotatably attached to said leg at a location spaced from said housing, thereby swivelly mounting said head to said housing.

3. The flashlight of claim 2, and further comprising means for retaining said head at a selected orientation with respect to said housing.

4. The flashlight of claim 2, wherein said leg is unitary with said housing.

5. A battery operated flashlight comprising a housing for the battery, a head having an interior, a bulb socket mounted in said head on the interior thereof and coupled to the battery, a pair of forwardly directed housing legs on said housing and extending into the interior of said head, a pair of forwardly directed head legs on said head in the interior thereof and located respectively adjacent to said housing legs, and pivot means disposed entirely in the interior of said head rotatably attaching said head legs respectively to said housing legs at locations spaced from said housing, thereby swivelly mounting said head to said housing.

6. The flashlight of claim 5, wherein said housing legs are outwardly biased and bear respectively against said head legs.

7. The flashlight of claim 5, wherein said housing legs are unitary with said housing, and said head legs.

8. The flashlight of claim 5, wherein said head has a pair of spaced-apart slits, said housing legs extending through said slits and into the interior of said head, said slits accommodating said head legs therein throughout the entire extent of swivelling of said head.

9. The flashlight of claim 5, wherein each of the head legs has a hole near the outer end thereof, said pivot means being a pin on each housing leg and unitary therewith, said pins being respectively journaled into said holes.

10. The flashlight of claim 2, wherein said housing has a curved front end portion, and said head includes a curved rear wall portion having a curvature that substantially matches the curvature of said front end portion, and further including a plurality of ridges on one of said portions, and a finger on the other of said portions being biased toward said one portion and carrying a detent which springingly enters the space between adjacent ridges corresponding to a selected orientation of said head.

11. A battery operated flashlight comprising a housing for the battery, a head having an interior, a bulb socket mounted in said head on the interior thereof and coupled to the battery, a pair of forwardly directed housing legs on said housing and extending into the interior of said head, a pair of forwardly directed head legs on said head in the interior thereof and located respectively adjacent to said housing legs, said housing legs being resilient and being outwardly biased to bear respectively against said head legs, each of said head legs having a pivot portion, and pivot means carried by said housing legs and disposed for resilient snap-fitting engagement with said pivot portions of said head legs for rotatably attaching said head legs respectively to said housing legs, thereby swivelly mounting said head to said housing.

12. The flashlight of claim 11, wherein each of said pivot portions comprises a hole near the outer end of the associated head leg, said pivot means being a pin on each housing leg, said pins being respectively journaled into said holes.

13. The flashlight of claim 12, wherein said housing legs and said pins are unitary with said housing and said head legs are unitary with said head.

* * * * *

UNITED STATES PATENT AND TRADEMARK OFFICE

CERTIFICATE OF CORRECTION

PATENT NO. : 4,447,863

DATED : May 8, 1984

INVENTOR(S) : Kenneth R. Fenne

It is certified that error appears in the above-identified patent and that said Letters Patent is hereby corrected as shown below:

On the title page, Item (73) Assignee was omitted, please add--Pittway Corporation, Aurora, Ill.--.

Signed and Sealed this

*Twentieth* Day of *August 1985*

[SEAL]

*Attest:*

DONALD J. QUIGG

*Attesting Officer* *Acting Commissioner of Patents and Trademarks*